United States Patent [19]

Fuchi et al.

[11] 4,070,594

[45] Jan. 24, 1978

[54] LIGHT SOURCE DEVICE TO BE UTILIZED MAINLY FOR PROJECTION PURPOSES

[75] Inventors: Tsutomu Fuchi, Takatsuki; Hiroshi Toyoda, Koga, both of Japan

[73] Assignee: Matsushita Electronics Corporation, Osaka, Japan

[21] Appl. No.: 656,860

[22] Filed: Feb. 10, 1976

[30] Foreign Application Priority Data

Feb. 13, 1975 Japan ..... 50-20301[U]
Feb. 19, 1975 Japan ..... 50-23631[U]

[51] Int. Cl.[2] ..... F21V 21/08; H01K 1/24; H01K 1/42; H01R 33/08

[52] U.S. Cl. ..... 313/1; 313/222; 339/52 R; 339/57; 362/225

[58] Field of Search ..... 313/1, 315, 222; 240/52.1; 339/50 R, 52 R, 57

[56] References Cited

U.S. PATENT DOCUMENTS

| | | | |
|---|---|---|---|
| Re. 12,907 | 1/1909 | Beuttell | 339/57 X |
| 940,021 | 11/1909 | Howard et al. | 313/315 X |
| 1,995,863 | 3/1935 | Prideaux | 313/315 X |
| 2,886,629 | 5/1959 | Van Geel | 339/50 R |
| 3,549,933 | 12/1970 | Smalley et al. | 339/52 R X |
| 3,633,023 | 1/1972 | Castiglioni | 313/1 X |
| 3,634,722 | 1/1972 | Palmer et al. | 313/222 X |

FOREIGN PATENT DOCUMENTS

| | | | |
|---|---|---|---|
| 611,830 | 2/1926 | France | 339/52 |
| 1,940,461 | 2/1971 | Germany | 313/222 |
| 420,613 | 12/1934 | United Kingdom | 339/57 |

*Primary Examiner*—Palmer C. Demeo
*Attorney, Agent, or Firm*—Burgess, Ryan and Wayne

[57] ABSTRACT

The present invention discloses a light source device to be utilized mainly for projection purposes in which a plurality of light-emitting sections and a plurality of non-light-emitting sections are alternately connected. Each light emitting section consisting of a halogen lamp comprising a lamp tube made of quartz and enclosing a coiled filament as a single light emitting element and sealing therein inert gas and halogen while the non-light-emitting section consisting of a supporting member for supporting the halogen lamp, the halogen lamps being electrically interconnected in series.

7 Claims, 5 Drawing Figures

LIGHT SOURCE DEVICE TO BE UTILIZED MAINLY FOR PROJECTION PURPOSES

BACKGROUND OF THE INVENTION

The present invention relates to a light source device, and more particularly an improvement of a light source especially adapted for use in a photocopying machine in which an object which is spaced apart from the light source by a relatively long distance must be illuminated with uniform intensity in the longitudinal direction of the object.

In general the conventional light sources for the purpose described above comprise a lamp tube made of quartz, Vycor or any other suitable heat-resistant glass, a coiled tungsten filament assembly enclosed in the tube and consisting of alternate light emitting coil sections and non-light-emitting coil sections so as to illuminate an object with uniform intensity, the object being spaced apart from the coiled filament assembly by a predetermined distance, and an inert gas such as argon and halogen or compounds thereof sealed in the lamp tube. In order to provide the non-light-emitting coil sections, a metal bar is placed in the coil assembly so as to short-circuit a desired number of coil turns. Alternatively, a section of coils is attached to the desired number of coils of the filament assembly or a plurality of light emitting coil sections and a plurality of non-light-emitting coils sections are alternately connected into a length of a coiled filament assembly. Therefore the fabrication is complex and involves a relatively large number of steps, and the cost is expensive. In addition, the light source device has a relatively long length so that the weight of the filament assembly enclosed in the lamp tube is considerably heavy. As a result, during the shipment or transportation and handling and operation when the light source device is mounted on a device, the coiled filament assembly tends to be displaced out of its supporting means, to be deformed and to be disconnected and broken of coiled filament due to vibrations. That is, the conventional light source devices have unsatisfactory mechanical strength.

SUMMARY OF THE INVENTION

One of the objects of the present invention is therefore to provide a light source device which may be fabricated in a simple manner and at less cost.

Another object of the present invention is to provide a light source device provided with a plurality of light source units which may prevent the deformation and breakage of the coiled filament so that the stable illumination characteristics may be attained.

A further object of the present invention is to provide a light source device which may be fabricated at less cost due to the economy of filament material and the rationalization of filament assemblies.

A further object of the present invention is to provide a light source device in which the oxidation and degradation of the conductors or wires due to the heat produced from the coiled filament during operation and the resulting failure of electrical connection and the cracking of the sealed end portions of the light bulb unit may be prevented.

A further object of the present invention is to provide a light source device especially adapted for use with a device such as a photocopying machine in which a relatively long area or object must be illuminated with uniform intensity.

The above and other objects, features and advantages of the present invention will become more apparent from the following description of the preferred embodiments thereof taken in conjunction with the accompanying drawing.

BRIEF DESCRIPTION OF THE DRAWING

Same reference numerals are used to designate similar parts throughout the figure

DESCRIPTION OF THE PREFERRED EMBODIMENTS

Figure 1:
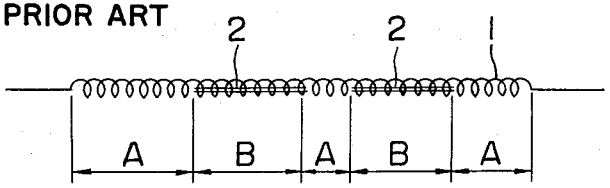
FIG. 1 PRIOR ART
FIG. 1 is a front view of a coiled filament used in a conventional light source device.

Prior Art, FIG. 1

In general, a conventional light source for illuminating with substantially uniform intensity an object in the longitudinal direction thereof comprises a tube made of quartz, Vycor glass or other suitable heat-resisting glass, and a coiled tungsten filament 1 consisting of alternate light emitting sections A and non-light-emitting sections B, the lamp tube being filled with inert gas such as argon and halogen or halogen compounds. In order to provide the non-light-emitting section B, a suitable metal bar 2 is placed in the coiled filament 1 so that a desired number of coil turns may be short-circuited. Instead of the short-circuiting metal bar 2, a coiled wire is also used. Alternatively, the filament assembly may consist of alternate light emitting coil sections and non-light-emitting coil sections. Therefore the fabrication of the conventional light sources of the type above involves a relatively large number of production steps, and the cost is high. Furthermore since the conventional light sources have a relatively long length, their mechanical strength is not satisfactorily strong. That is, the filament assembly is long so that its weight is great. Therefore during the shipment or transportation and handling, the filament assembly very often tends to be displaced out of its initial position or supporting means, to be deformed and to be broken.

Figure 2:
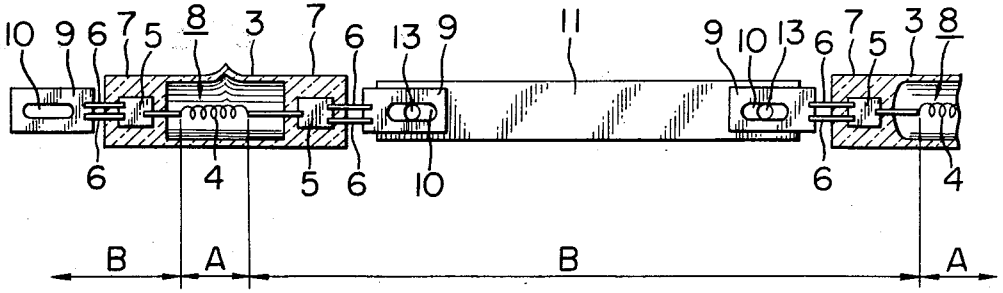
FIG. 2 is a fragmentary top view of a first embodiment of a light source device in accordance with the present invention.
Figure 3:
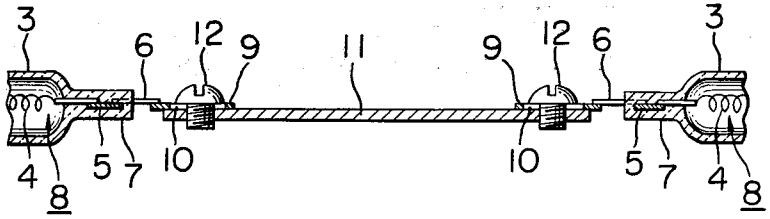
FIG. 3 is a longitudinal sectional view thereof.

First Embodiment, FIGS. 2 and 3

In FIGS. 2 and 3, there is shown a first embodiment of a light source in accordance with the present invention comprising, in general, light source units 8, connecting members 9 and supporting members 11. The light source unit 8 comprises a tube or bulb which is made of quartz, Vycor or other suitable heat-resisting glass and which encloses as a single light emitting element a coiled tungsten filament 4 extended in the axial direction of the tube 3. Both ends of the coiled filament 4 are connected to one end of metal foils 5 made of molybdenum, and one end of each tungsten or molybdenum feed-in wire 6 is connected to the other end of the metal foil 5 while the other end is joined by welding to the metal connecting plate 9 made of, for instance, nickel. After being filled with inert gas such as argon and a halogen element such as bromine, chlorine, iodine or halogen compounds, both ends of the tube 3 are sealed by a suitable conventional pressing method such as indicated at 7, and the metal foil 5 is embedded in the sealed portion 7 while the lead-in wires 6 are extended out of the sealed end portion 7 for connection to the metal connecting plate 9. In the first embodiment, one end of each lead-in wire 6 has been described and shown as being joined to the metal foil 5, but it may suffice to connect one end of only one lead-in wire 6 to the metal foil 5. More particularly, one end of one lead-in wire is connected to the metal foil 5 while one end of the other lead-in wire is embedded in the sealed portion 7 without being connected to the metal foil 5, but the other end of each lead-in wire is connected to the metal connecting member 9. In either cases, the light source unit 8 may have sufficient strength to withstand the shock or impact imparted thereto at perpendicular angles to the axis thereof.

The connecting member 9 (metal plate) has a screw-fixing hole 10 in rectangular, elliptical, polygonal or circular shape, this plate 9 is sliding freely toward longitudinal direction of the tubular light source unit, and a screw 12 is inserted into the elongated opening 10 and is screwed into a screw hole 13 tapped through the supporting member 11. The supporting member 11 is made of nickel plate or steel plate coated with nickel or other suitable metals. Alternatively, it may be made of a heat-resisting electrically insulating material. The adjacent light source units 8 are electrically connected through the metal connecting members 9 and the supporting member 11 when the latter is made of a metal. In order to ensure the safety for handling the supporting member 11 is made of a metal plate, or when the supporting member 11 is made of an electrically insulating material, a connecting wire (not shown) may be extended between the screws 12 with both ends of the connecting wire being made into electrical contact with the metal connecting members 9, and electrically insulating rings are fitted over the screws 12.

The connecting member 9 to which are attached the lead-in wires 6 extruded from the end of the sealed portion 7 of the light source unit 8 may be of any shape, and is preferably spaced apart from the end of the sealed portion 7 by a small distance so that the undesired deterioration of the metal connecting member 9 due to the heat dissipated from the light source unit 8 during operation may be prevented. It is not preferable to design the metal connecting member 9 in such a way that the member 9 may surround or enclose the sealed end portion 7 because the oxidation and deterioration of the lead-in wires 6 will result due to the overheating of the sealed end portion 7 of the light source unit 8 during operation and because the connection between the metal connecting member 9 and the lead-in wires 6 will become very complex.

The supporting member 11 may be a metal bar or wire or may be the base of a metal reflecting mirror used in conjunction with the light source in accordance with the present invention. In addition, the material and shape of the supporting member may be suitably selected as needs demand.

Figure 4:
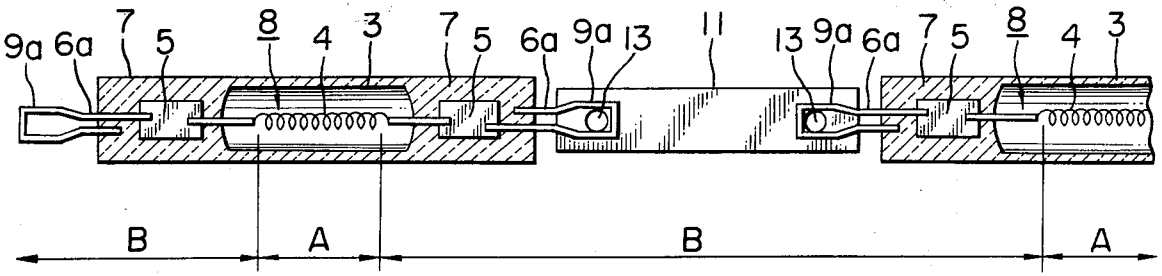
FIG. 4 is a fragmentary top view, partly in section, of a second embodiment of a light source device in accordance with the present invention.
Figure 5:
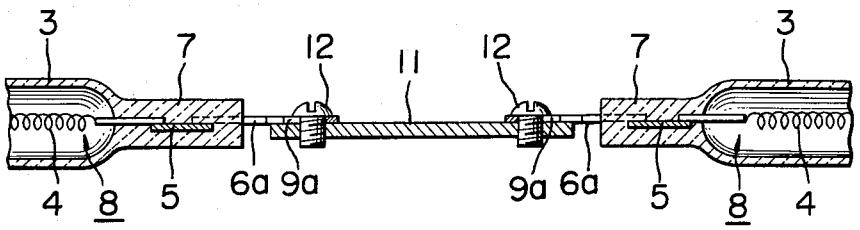
FIG. 5 is a longitudinal sectional view thereof.

Second Embodiment, FIGS. 4 and 5

The second embodiment shown in FIGS. 4 and 5 is substantially similar in construction to the first embodiment described above with reference to FIGS. 2 and 3 except for the arrangement of the lead-in wire 6*a*. That is, one end of the lead-in wire 6*a* is securely joined to the metal foil 5, and the portion extended out of the sealed end portion 7 of the light source unit 8 is bent to form an axially elongated loop 9*a* so that the adjustment of the spacing between the sealed end portion 7 of the light source unit 8 and the supporting member 11 may be facilitated. The axially elongated loop 9*a* may be therefore of any shape such as rectangular, ellipse or the like as long as the width of the loop is less than the diameter of the head of the screw 12. In assembly, the screw 12 is inserted into the loop 9*a* of the lead-in wire 6*a* and is tightly screwed into the screw hole 13 tapped through the supporting member 11. Preferably the loop 9*a* is spaced apart from the end of the sealed portion 7 by a suitable distance in order to reduce the adverse effect of heat dissipated in the light source unit 8 during operation on the joint between the lead-in wire 6*a* and the supporting member 11, thereby preventing the deterioration of the joint or connecting wire and the resulting failure of electric connection between the lead-in wire 6*a* and the supporting member 11 or connecting wire.

In both the first and second embodiments, the light emitting section A is made up of the coiled filament 4 in the light source unit 8 while the non-light-emitting section B consists of the supporting member 11 and the part of the adjacent tubular light source units 8.

As described above, the light source in accordance with the present invention comprises a plurality of light source units 8 and a plurality of supporting members 11, the units 8 and members 11 being alternately interconnected. Therefore the fabrication is much simplified; the cost is inexpensive; and the installation and replacement are much facilitated. In other words, the present invention may eliminate the conventional long coiled tungsten filament assembly extended over the whole length of the light source with the short-circuit metal bars or coils within a long tubular envelope to provide the combined member of plural light emitting short coils and the non-light-emitting coils. As a result, much economy of the coiled tungsten filaments may be attained; the assembly of coiled tungsten filaments may be facilitated; and the resistance to vibrations, shocks or impacts may be considerably improved. In addition, the lead-in wires of the light source units are connected directly or through the metal connecting members to the supporting members, which constitute part of the non-light-emitting section B, so that the adverse thermal effect from the light source units on the joints between the lead-in wires or metal connecting members and the metal supporting members and/or connecting wires may be minimized. That is, the oxidation of the lead-in wires and the resulting failure of the electrical connection between the lead-in wires and the metal supporting member or connecting wires may be prevented. Furthermore, the cracking of the sealed portions of the light source units may be prevented. The mechanical strength of the light source in accordance with the present invention is so satisfactory that it may be used in conjunction with suitable reflector means. In addition, as shown in the drawings, the non-light-emitting elements 11 support the light emitting units 8 in tension through lead wires 6, 6*a* along the axes of the attached light emitting units.

So far depending upon the requirements for the light sources, a wide variety of coiled filaments must be designed. However, according to the present invention any light source requirements may be readily satisfied because various combinations of the relatively short light source units or light emitting sections with the supporting members or non-light-emitting sections may be obtained. Therefore any objects may be illuminated with uniform intensity. Furthermore in accordance with the present invention, the coiled tungsten filaments are relatively short so that only one filament anchor is required or the use of filament anchors may be eliminated. As a result, the manufacturing process of this light source unit may be much simplified, and material cost is being reduced.

The light source in accordance with the present invention is therefore particularly advantageous when used in a device such as a copying machine in which an elongated area with a relatively long length must be illuminated uniformly.

In addition to the economy of the filament materials, the economy of the expensive lamp tube materials such as quartz may be attained, and when the reflectors are combined with the light source units in accordance with the present invention, the supports of the reflectors may be used as the supporting members or non-light-emitting sections so that further economy of materials may be attained and consequently the cost may be considerably reduced.

What is claimed is:

1. In an elongated light source device to be used mainly for projection purposes of the type comprising a plurality of series connected tubular light source units each containing a single light emitting element, and a plurality of non-light-emitting sections connected between alternate light source units of said series connected light source units, the improvement wherein said non-light-emitting sections each comprise an elongated rigid metal conductor supporting member connected at each end to a different light source unit, the longitudinal dimension of each of said non-light-emitting sections being substantially aligned with the axes of said light source units connected thereto, each of said non-light-emitting members being fixed to said tubular light source units in such a way that a metal plate is fixed to the non-light-emitting supporting member and is connected to at least one lead-in wire extending from the end sealing portion of an adjacent one of said tubular light source units, wherein a screw is provided for connecting said at least one lead-in wire to said supporting member, and wherein said metal plate is provided with a screw-fixing hole having a dimension in the longitudinal direction of said conductor that exceeds the diameter of said screw, whereby said metal plate is slidably movable in the longitudinal direction of the adjacent tubular light source unit.

2. A light source device as claimed in claim 1 wherein at least one lead-in wire is embedded in the sealing portion in such a manner that only one lead-in wire is connected to a metal foil and any additional lead-in wire(s) will not be connected to the metal foil.

3. A light source device as claimed in claim 1 wherein said tubular light source unit consists of an incandescent lamp.

4. A light source device as claimed in claim 3 wherein said lamp consists of a glass valve, said single light emitting element or coiled filament is enclosed in said glass valve, and an inert gas and halogen is sealed in said glass valve.

5. In an elongated light source device to be used mainly for projection purposes of the type comprising a plurality of series connected tubular light source units each containing a single light emitting element, and a plurality of non-light-emitting sections connected between alternate light source units of said series connected light source units, the improvement wherein said non-light-emitting sections each comprise an elongated rigid metal conductor supporting member connected at each end to a different light source unit, the longitudinal dimension of each of said non-light-emitting sections being substantially aligned with the axes of said light source units connected thereto, said non-light-emitting supporting members being fixed to said tubular light source units in such a way that a lead-in wire extends from the end sealing portion of each of said tubular light source units and is bent to form a mounting loop through which a screw for fixing said supporting member extends, said loop having a dimension in the axial direction of said light emitting elements that exceeds the diameter of said screw, whereby said supporting member is slidably movable toward the longitudinal direction of the adjacent tubular light source unit.

6. In an elongated light source device to be used mainly for projection purposes of the type comprising a plurality of series connected tubular light source units each containing a single light emitting element, and a plurality of non-light-emitting sections connected between alternate light source units of said series connected light source units, the improvement wherein said non-light-emitting sections each comprise an elongated rigid metal plate conductor supporting member connected at each end to a different light source unit, the longitudinal dimension of each of said non-light-emitting sections being substantially aligned with the axes of said light source units connected thereto, each of said non-light-emitting members being fixed to said tubular light source units in such a way that a metal plate is fixed to the non-light-emitting supporting member and is connected to at least one lead-in wire extending from the end sealing portion of an adjacent one of said tubular light source units.

7. In an elongated light source device to be used mainly for projection purposes of the type comprising a plurality of series connected tubular light source units each containing a single light emitting element, and a plurality of non-light-emitting sections connected between alternate light source units of said series connected light source units, the improvement wherein said non-light-emitting sections each comprise an elongated rigid metal plate conductor supporting member connected at each end to a different light source unit, the longitudinal dimension of each of said non-light-emitting sections being substantially aligned with the axes of said light source units connected thereto, each of said non-light-emitting supporting members being fixed to said tubular light source units in such a way that a lead-in wire extends from the end sealing portion of each of said tubular light source units and is bent to form a mounting loop through which a screw for fixing said supporting member extends.

* * * * *

UNITED STATES PATENT OFFICE

CERTIFICATE OF CORRECTION

Patent No. 4,070,594 Dated January 24, 1978

Inventor(s) Tsutomu Fuchi, et al

It is certified that error appears in the above-identified patent and that said Letters Patent are hereby corrected as shown below:

Column 4, line 57: cancel "In addition".

Column 4, lines 58 - 61: These lines should be cancelled.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*